US005694072A

United States Patent [19]

Hsiao et al.

[11] Patent Number: 5,694,072

[45] Date of Patent: Dec. 2, 1997

[54] PROGRAMMABLE SUBSTRATE BIAS GENERATOR WITH CURRENT-MIRRORED DIFFERENTIAL COMPARATOR AND ISOLATED BULK-NODE SENSING TRANSISTOR FOR BIAS VOLTAGE CONTROL

[75] Inventors: Charles Hsiao, Fremont; Michael B. Cheng, San Jose; David Kwong, Fremont, all of Calif.

[73] Assignee: Pericom Semiconductor Corp., San Jose, Calif.

[21] Appl. No.: 520,028

[22] Filed: Aug. 28, 1995

[51] Int. Cl.[6] ..... G05F 1/10

[52] U.S. Cl. ..... 327/537; 327/536; 327/540

[58] Field of Search ..... 327/534, 535, 327/536, 537, 540

[56] References Cited

U.S. PATENT DOCUMENTS

| | | | |
|---|---|---|---|
| Re. 34,797 | 11/1994 | Sato et al. | 365/189.09 |
| 4,307,307 | 12/1981 | Parekh . | |
| 4,439,692 | 3/1984 | Beekmans et al. . | |
| 4,471,290 | 9/1984 | Yamaguchi | 327/535 |
| 4,656,369 | 4/1987 | Lou . | |
| 4,769,784 | 9/1988 | Doluca et al. | 327/537 |
| 5,184,030 | 2/1993 | Chung et al. . | |
| 5,185,535 | 2/1993 | Farb et al. . | |
| 5,202,587 | 4/1993 | McLaury . | |
| 5,202,588 | 4/1993 | Matsuo et al. . | |
| 5,227,675 | 7/1993 | Taguchi | 327/535 |
| 5,243,228 | 9/1993 | Maruyama et al. . | |
| 5,251,172 | 10/1993 | Yamauchi | 365/189.09 |
| 5,315,557 | 5/1994 | Kim et al. | 365/222 |
| 5,327,072 | 7/1994 | Savignac et al. | 323/313 |
| 5,347,172 | 9/1994 | Cordoba et al. . | |
| 5,376,840 | 12/1994 | Nakayama | 327/537 |
| 5,394,026 | 2/1995 | Yu et al. . | |
| 5,504,447 | 4/1996 | Egging | 327/334 |

FOREIGN PATENT DOCUMENTS

| | | | |
|---|---|---|---|
| 57-199335 | 12/1982 | Japan | 327/534 |

*Primary Examiner*—Terry Cunningham
*Attorney, Agent, or Firm*—Stuart T. Auvinen

[57] ABSTRACT

A substrate bias generator for an integrated circuit has a charge pump driven by an oscillator. The oscillator is enabled and disabled to save power and control the voltage-level itself for the substrate bias. An enabling circuit senses the substrate voltage and enables the oscillator when the substrate voltage rises above a bias set by a programmable reference voltage. The enabling circuit which senses the voltage on the substrate draws no active current from the substrate. The sensing circuit includes a transistor with only its bulk terminal connected to the substrate; the source, gate, and drain of this sensing transistor are not connected to the substrate. A differential comparator compares the output of the sensing transistor to the programmable reference voltage and enables the oscillator when the sensing transistor output is lower than the reference voltage. The sensing transistor attenuates large swings in the substrate voltage to provide the differential comparator with a small voltage swing which keeps the differential comparator operating near its optimum design point. Since no active current is drawn from the substrate when sensing the substrate voltage, no IR voltage drops can develop from the enabling and sensing circuit. Thus latch-up immunity is improved and substrate noise is reduced.

15 Claims, 4 Drawing Sheets

32

PROGRAMMABLE SUBSTRATE BIAS GENERATOR WITH CURRENT-MIRRORED DIFFERENTIAL COMPARATOR AND ISOLATED BULK-NODE SENSING TRANSISTOR FOR BIAS VOLTAGE CONTROL

BACKGROUND OF THE INVENTION—FIELD OF THE INVENTION

This invention relates to semiconductor integrated circuits, and more particularly for substrate bias generators.

BACKGROUND OF THE INVENTION—DESCRIPTION OF THE RELATED ART

Substrate bias generators are used for latch-up prevention and noise suppression, and to control threshold voltages for metal-oxide-semiconductor (MOS) transistors. While many variations for substrate bias generators have been disclosed, generally an oscillator drives one or more capacitors which pump nodes between diodes. Current flows through the diodes in one direction only, effectively pumping charge from a substrate node ($V_{BB}$) to a ground node ($V_{SS}$). Typically transistors with their gates tied to their drains are used for the diodes.

Portable systems which run off battery power must be build with semiconductor chips with reduced power consumption. The oscillator for the substrate bias generator consumes D.C. power since nodes within the oscillator are constantly charged and discharged. This power consumption can be reduced by disabling the oscillator and periodically re-enabling the oscillator when substrate leakage alters the substrate bias.

For example, Cordoba et al., U.S. Pat. No. 5,347,172, disclose a substrate voltage regulator which enables self-timed clocks which activate the charge pumps for a period of time to refresh the substrate bias. His regulator compares to Vcc/2 a reference voltage $V_{BREF}$ (generated from a voltage-divider network) which is proportional to the substrate voltage.

Yu et al., U.S. Pat. No. 5,394,026 disclose using an n-channel transistor with its source and substrate connected to $V_{BB}$ for sensing the substrate voltage and enabling the oscillator. Unfortunately, current is sinked into the substrate node by the sensing circuit since the source of the n-channel transistor is directly connected to the substrate node. Currents in the substrate are undesirable since they can cause IR voltage drops which may cause latch-up or noise.

While these and other disclosed substrate bias generators effectively reduce power by disabling the oscillator, more sensitive and controllable feedback from the substrate voltage is desired. Another desire is to isolate the substrate from nodes in the substrate bias generator which might sink current into the substrate, thus eliminating active currents running through the substrate.

It is also desired to control the magnitude of the substrate bias by controlling when the oscillator is enabled or disabled, rather than simply by the number of diodes in the charge pump.

SUMMARY OF THE INVENTION

A substrate bias generator for an integrated circuit has a charge pump driven by an oscillator. The oscillator is enabled and disabled to save power and control the voltage-level for the substrate bias. An enabling circuit senses the substrate voltage and enables the oscillator when the substrate voltage rises above a bias set by a programmable reference voltage. The enabling circuit which senses the voltage on the substrate draws no active current from the substrate. The sensing circuit includes a transistor with only its bulk terminal connected to the substrate; the source, gate, and drain of this sensing transistor are not connected to the substrate.

A substrate bias generator generates a substrate bias voltage applied to a substrate. An oscillator responds to an enabling signal. The oscillator generates a clock when the enabling signal is in a first state. However, the oscillator enters a low-power-consumption mode when the enabling signal is not in the first state. A charge pump responds to the clock from the oscillator. It pumps charge from a substrate and generates the substrate bias voltage and outputs the substrate bias voltage to the substrate. An enable circuit responds to the substrate bias voltage. The enable circuit generates the enabling signal. The enable circuit includes a sensing means that receives the substrate bias voltage but does not draw active current from the substrate. The sensing means includes means a for attenuating changes in the substrate bias voltage and generates an attenuated bias reference voltage.

A differential comparator receives the attenuated bias reference voltage and a reference voltage. The attenuated bias reference voltage is compared to the reference voltage and the enabling signal is output in the first state when the substrate bias voltage has crossed over a set point determined by the reference voltage. Thus active current is not drawn from the substrate by the enable circuit.

In other aspects the sensing means and attenuation means comprise a MOS transistor. The MOS transistor receives the substrate bias voltage at a bulk terminal. The bulk terminal does not draw active current but only draws leakage currents. The MOS transistor does not receive the substrate bias voltage at any terminal other than the bulk terminal. The MOS transistor generates the attenuated bias reference voltage at a drain terminal of the MOS transistor. The changes in the substrate bias voltage change the threshold voltage of the MOS transistor, and the attenuated bias reference voltage at the drain terminal changes in response to a change in the threshold voltage.

The sensing transistor attenuates large swings in the substrate voltage to provide the differential comparator with a small voltage swing which keeps the differential comparator operating near its optimum design point. Since no active current is drawn from the substrate when sensing the substrate voltage, no IR voltage drops can develop from the enabling and sensing circuit. Thus latch-up immunity is improved and substrate noise is reduced.

DETAILED DESCRIPTION

The present invention relates to an improvement in substrate bias generators. The following description is presented to enable one of ordinary skill in the art to make and use the invention as provided in the context of a particular application and its requirements. Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

Figure 1:
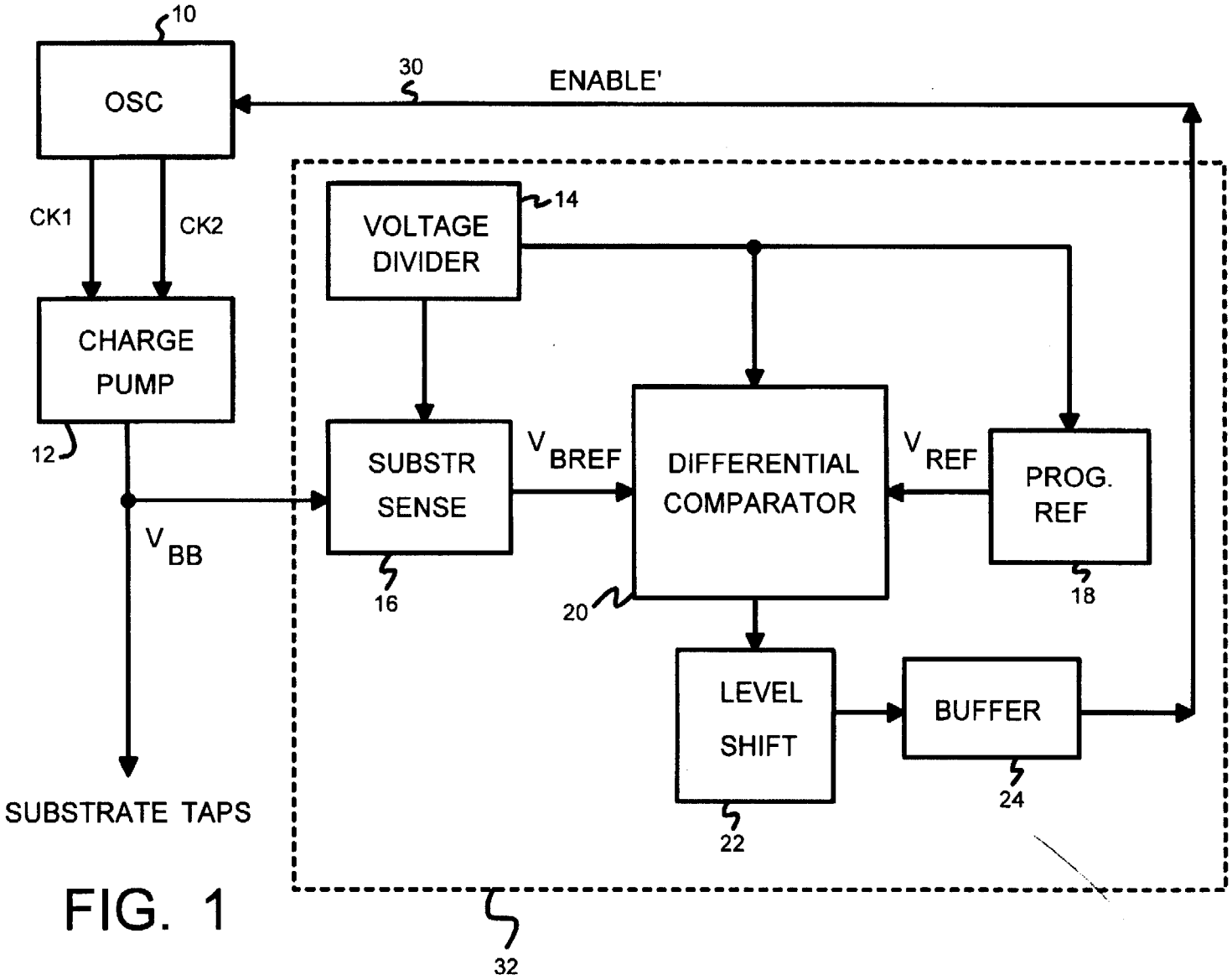
FIG. 1 is a block diagram of a programmable substrate bias generator.

FIG. 1 is a block diagram of a programmable substrate bias generator. Oscillator 10 is enabled by enable signal 30. When enable signal 30 is inactive, oscillator 10 does not oscillate and therefore draws almost no power when implemented in CMOS. Oscillator 10 generates clocks which are applied to charge pump 12. Charge pump 12 pumps charge to substrate node $V_{BB}$ from a ground node $V_{SS}$. Thus the bulk or substrate voltage $V_{BB}$ is several volts lower than the ground voltage. The substrate node $V_{BB}$ is connected to the bulk or substrate terminal of many n-channel transistors (not shown), which can be located in a p-type substrate or one or more P-Wells. Often all n-channel transistors have their bulk nodes electrically connected to the same substrate node.

Enable circuit 32 receives substrate voltage $V_{BB}$ and generates enable signal 30 when substrate voltage $V_{BB}$ has risen above a programmable reference voltage. Leakage within the substrate causes substrate voltage $V_{BB}$ to rise when charge pump 12 and oscillator 10 are disabled. Since it is desired to maintain $V_{BB}$ at a relatively constant voltage, enable signal 30 must periodically be activated to allow $V_{BB}$ to be pumped back down to its nominal value.

Substrate sensor 16 senses substrate voltage $V_{BB}$ but without drawing active current from substrate node $V_{BB}$. Thus active currents are not drawn through the substrate. Since the substrate can have a relatively high resistance, active currents through the substrate could cause significant IR voltage drops. These voltage drops can initiate latch up or cause noise or device mis-match.

Differential comparator 20 receives substrate reference voltage $V_{BREF}$ from substrate sensor 16 and compares this reference voltage to a programmable reference voltage $V_{REF}$. The comparison result is output by differential comparator 20 and inverted by inverting stage 22 before being buffered by buffer 24, which outputs enable signal 30 to oscillator 10.

Programmable reference voltage $V_{REF}$ is generated by programmable reference 18. Voltage divider 14 supplies reference voltages to current sources in substrate sensor 16, differential comparator 20, programmable reference 18, and inverting stage 22. having one set of reference voltages supplied to all components allows the current sources to track each other, improving accuracy.

Figure 2:
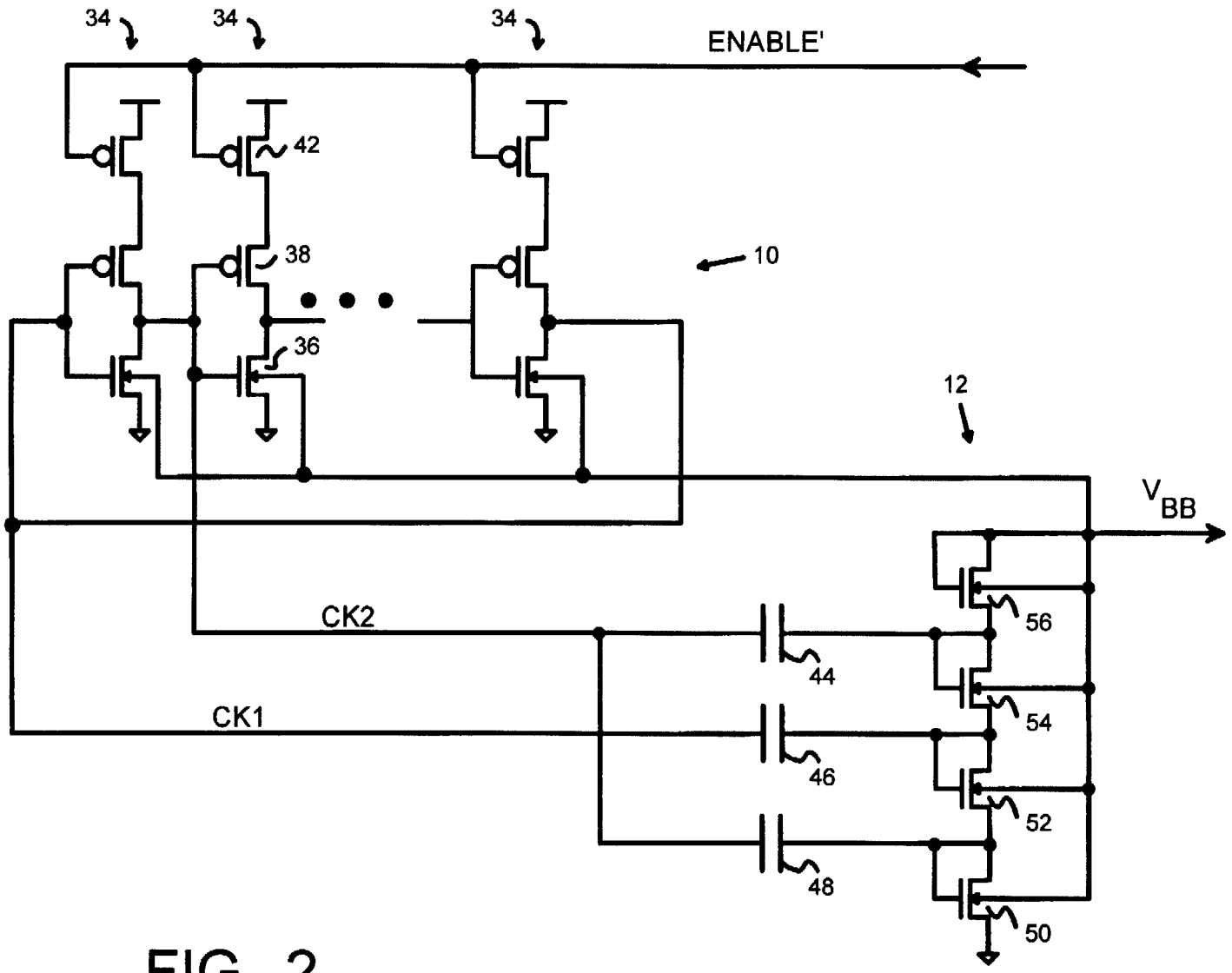
FIG. 2 is a schematic of an oscillator and a charge pump.

Oscillator & Charge Pump—FIG. 2

FIG. 2 is a schematic of oscillator 10 and charge pump 12. Oscillator 10 is a ring oscillator having a series of back-to-back inverter stages 34. Each stage 34 contains n-channel pull-down transistor 36, p-channel pull-up transistor 38, and enabling p-channel transistor 42. When enable signal 30 is active (low) each stage 34 functions as an inverter, and oscillator 10 oscillates since an odd number of stages 34 in a ring has no stable state. Clocks CK1, CK2 generate non-overlapping pulses which are inverted relative to the other clock.

When enable signal 30 is inactive (high), enabling p-channel transistors 42 are shut off and do not conduct, and stages 34 are not able to drive their outputs high. Thus the oscillation stops. D.C. power is not consumed as there is no longer any path to power, $V_{DD}$. Note that the bulk terminals of n-channel pull-down transistors 36 are connected to substrate node $V_{BB}$.

Charge Pump

Clock CK1 is applied to capacitor 46, while clock CK2 is applied to capacitors 44, 48. The other terminal of capacitors 44, 46, 48 are connected to the gates and drains of transistors 50, 54, 56, respectively. N-channel transistors 50, 52, 54, 56 act as diodes since their gates are tied to their drains. Thus these transistors conduct when their gates and drains are at least a threshold voltage above their sources. When their gates and drains are less than a threshold voltage above their sources they are cut off and do not conduct through their channels.

Charge pump 12 pumps charge using capacitors 44, 46, 48. Oscillator 10 ideally applies a full 5-volt swing to one side of the capacitors. This 5-volt swing is coupled to the other side of the capacitors, but the voltage swing coupled across the capacitors is not a full 5 volts. The coupled voltage swing is reduced or attenuated by the capacitive coupling ratio, the ratio of the capacitance of the pumping capacitors 44, 46, 48 to the total capacitance on a node, including parasitic capacitances and the gate capacitance. For example, if a 5-volt swing is applied to capacitor 48, with a capacitive coupling ratio of 0.6, the coupled voltage swing on the drain of transistor 50 is reduced to 3 volts.

The rising edge of CK2 couples a 3-volt rise across capacitor 48 to the gate and drain of transistor 50. The initial voltage on the gate of transistor 50 is about one n-channel threshold voltage drop below ground. As the 3-volt swing is coupled across capacitor 48, the voltage on the gate of transistor 50 rises. Once this voltage reaches the threshold voltage above ground, about 0.7 volts, transistor 50 turns on and discharges and charge stored on capacitor 48 to ground. If transistor 50 is large enough and the oscillator frequency is slow enough, the voltage on capacitor 48 and the gate of transistor 50 is discharged until it reaches the threshold voltage, 0.7 volts, when transistor 50 again turns off, leaving the voltage at 0.7 volts.

On the next falling edge of clock CK2, transistor 50 remains off, but transistor 52 turns on once the voltage on its source drops a threshold voltage below its gate and drain. Thus as the 3-volt swing is coupled across capacitor 48, the voltage on the source of transistor 52 also drops to 3 volts below 0.7 volt. Once this voltage reaches about −0.7 volts, transistor 52 turns on and discharges capacitor 46 onto capacitor 48. When the voltage difference between the gate/drain and source of transistor 52 becomes less than a transistor threshold, then transistor 52 turns off, leaving the voltage on the right side of capacitor 46 a threshold voltage above the voltage on capacitor 48.

This cycle repeats, drawing charge from capacitor 46 through transistor 52 to capacitor 48 on the falling edges of clock CK2, but discharging capacitor 48 to ground on the rising edges of clock CK2. A similar pumping action occurs for the rising and falling edges of clock CK1, where charge is moved from capacitor 44 through transistor 54 to capacitor 46 on the falling edge of clock CK1, and then from capacitor 46 through transistor 52 to capacitor 48 on the rising edge of clock CK1. The transistor sizes for oscillator 10 can be chosen so that the edges for clocks CK1, CK2 are non-overlapping, or some overlap can be used is simulated carefully.

Thus charge is pumped from the substrate's node through transistor 56 to capacitor 44, then through transistor 54 to capacitor 46, and then through transistor 52 to capacitor 48, and finally through transistor 50 to ground. While the voltages of each node vary during the pumping cycle, at steady-state each transistor's gate is one threshold voltage above its source, the point where each transistor turns off. Thus $V_{BB}$ is about four n-channel transistor thresholds below ground. The minimum voltage on $V_{BB}$ is determined in steady-state by the number of transistors in series to a first approximation, and the thresholds of these transistors.

More detail on the theory of charge pumping is found in U.S. Pat. No. 5,243,228 to Maruyama et al., FIG. 5 and cols. 4–5.

Figure 3:
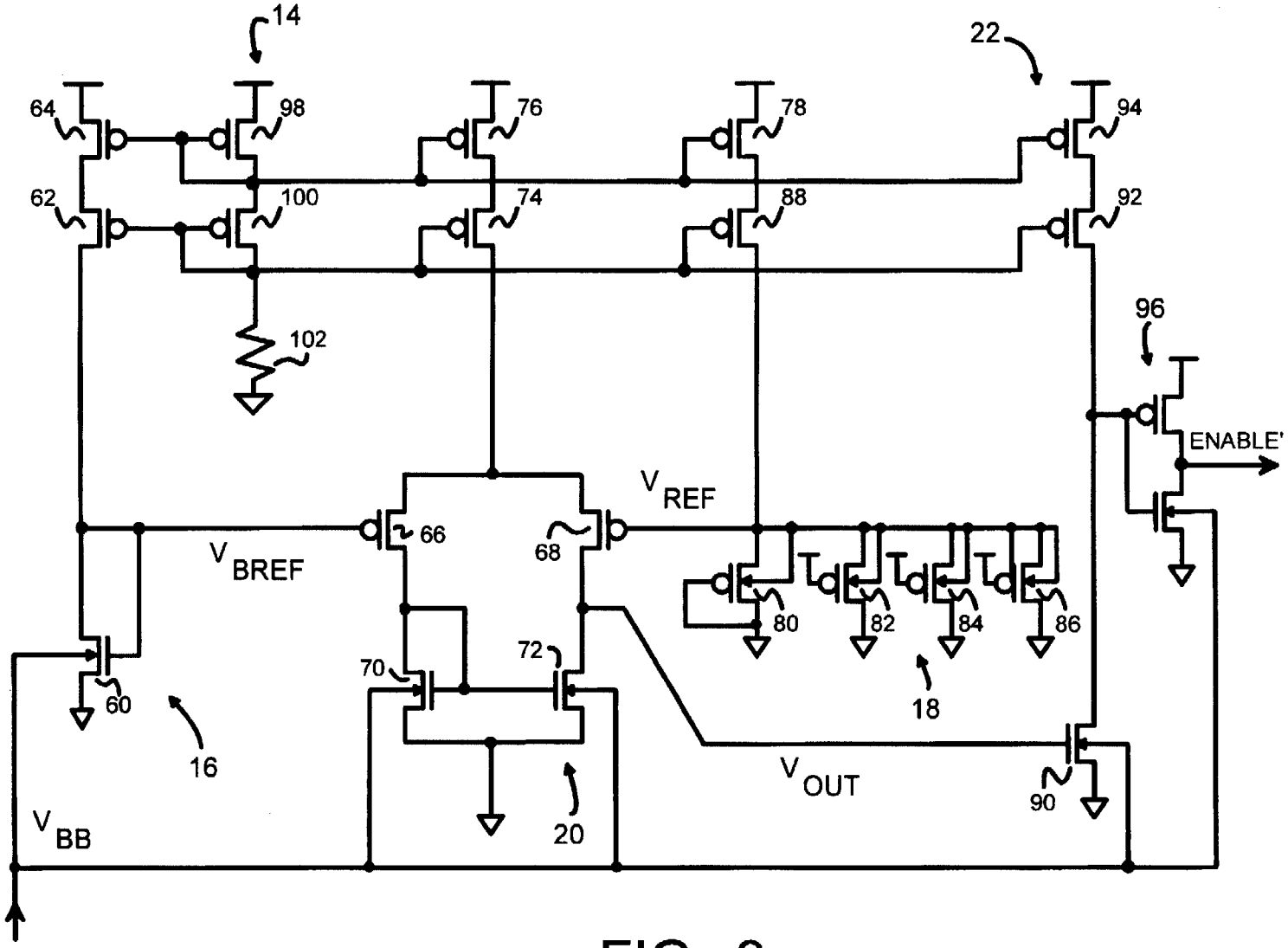
FIG. 3 is a schematic diagram of an enable and sensing circuit according to the invention.

Sensing and Enable Circuit—FIG. 3

FIG. 3 is a schematic diagram of enable circuit 32. Sensing transistor 60 has its bulk terminal connected to substrate node $V_{BB}$. None of the other terminals of sensing transistor 60 is connected to substrate node $V_{BB}$. Thus no active current is drawn from or sinked into substrate node $V_{BB}$.

Voltage divider 14 includes p-channel transistors 98, 100 and resistor 102. The gates of p-channel transistors 98, 100 are tied to their drains, and are used as reference gate voltages in current sources for other portions of enable circuit 32. Current-source transistors 64, 62 bias the drain and gate of sensing transistor 60 to about 1.6 volts when power (Vcc) is 5.0 volts.

Attenuation of $V_{BB}$ Swings Beneficial for High-Gain Amp

Sensing transistor 60 attenuates changes in substrate voltage $V_{BB}$. Attenuation is needed because the differential comparator is a very sensitive amplifier, and large input voltage swings can wash out the small-signal amplification of the comparator. These large voltage swings can upset the bias voltages in the differential comparator and move these bias voltages enough to alter the gain of the differential comparator.

Figure 4:
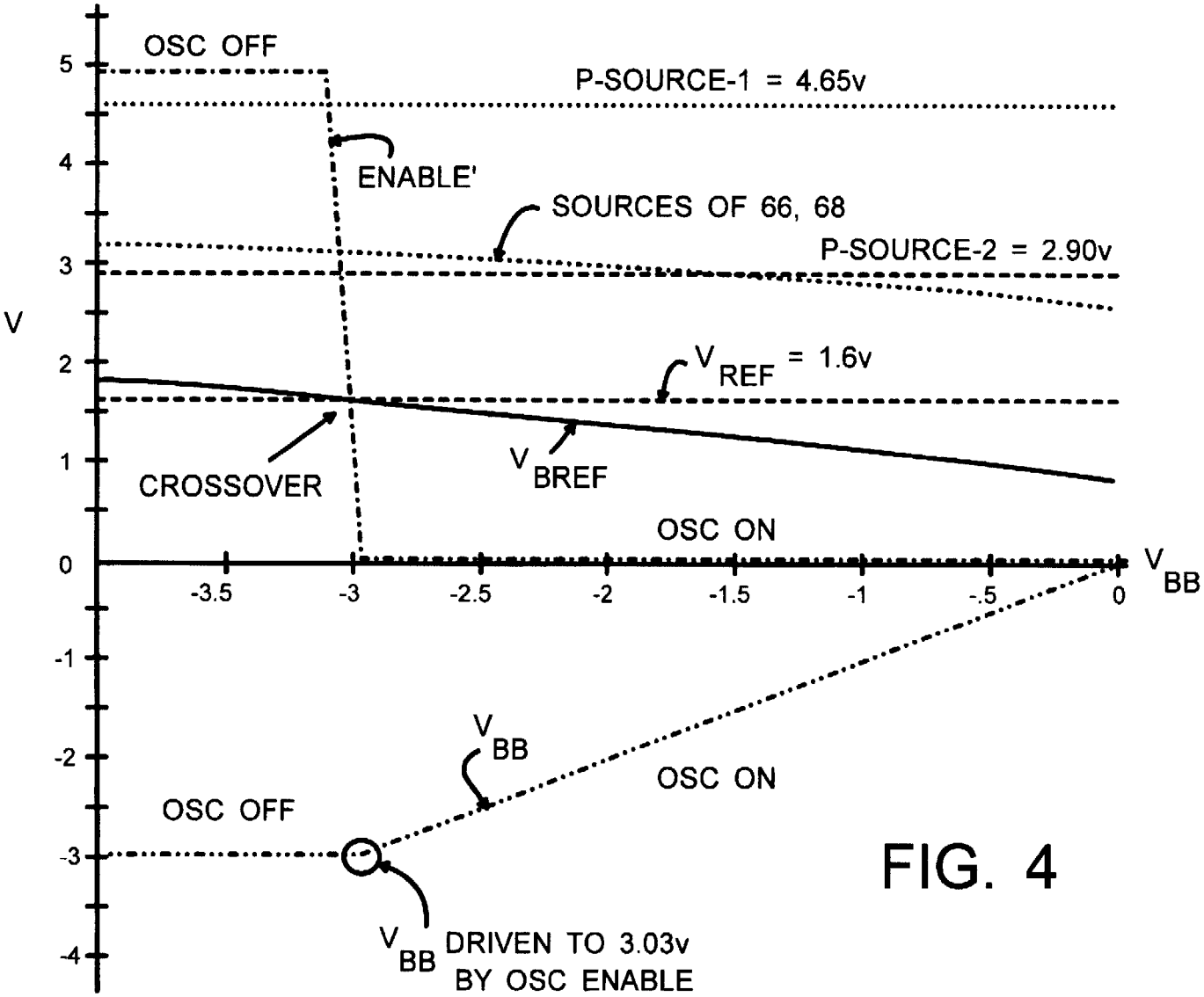
FIG. 4 is a plot of various voltages in the enable and sensing circuit in the substrate bias generator.

As an example, FIG. 4 shows that a 3-volt swing in $V_{BB}$ from −3 to 0 volts, is attenuated to a 1-volt swing, from 1.7 to 0.7 volts, for $V_{BREF}$. Thus applying the substrate voltage to the bulk terminal and not to the source or gate terminals of sensing transistor 60 has the unexpected advantage of voltage attenuation as well as substrate isolation. If the substrate voltage $V_{BB}$ were applied to the gate of sensing transistor 60, then less attenuation would result. The gate-to-source voltage would change in proportion to the substrate voltage change. Drain current is much more sensitive to gate-to-source voltage than to bulk voltage. This is because drain current is proportional to the square of the gate-to-source voltage, but only directly proportional to the bulk voltage. Thus using the bulk terminal rather than the source or gate terminals attenuates the voltage swings in the substrate to within a reasonable small-signal swing for input to a differential amplifier.

Sensing transistor 60 also easily performs a large level shift in a single stage. The substrate bias voltage, typically −3.0 volts, is shifted up to the attenuated bias reference voltage at the drain of transistor 60. This drain is at least a transistor threshold voltage above ground, so a shift of 4 or more volts is accomplished without using several additional power-consuming stages.

Programmable Reference Voltage

Programmable reference 18 includes a current source of p-channel transistors 78, 88, with gate voltages set by voltage divider 14. As shown in FIG. 3, only p-channel transistor 80 is programmed for use in the circuit, while p-channel transistors 82, 84, 86 are programmed off by having their gates tied high. Transistor 80 is programmed for use (on) by having its gate tied to ground. P-channel transistors are used for pull-downs rather than n-channel transistors because their bulk nodes are tied to $V_{REF}$, their sources, rather than the substrate node. Thus p-channel transistors 80, 82, 84, 86 are not sensitive to the substrate voltage $V_{BB}$ at all and make for a constant reference independent of $V_{BB}$.

Transistors 80, 82, 84, 86 are programmed for use or off preferably with a metal-mask option. Alternately a test structure may be arranged whereby metal lines connecting the gates to either $V_{DD}$ or ground may be scratched out with a small probe tip on an engineering workstation during device debugging. By programming more of transistors 80, 82, 84, 86 for use, the reference voltage $V_{REF}$ may be lowered, decreasing the magnitude of the substrate bias voltage.

Table 1 below shows how the reference voltage $V_{REF}$ and substrate bias $V_{BB}$ change for different transistor sizes for transistor 80, 82, 84, 86. While multiple devices of transistors 80, 82, 84, 86 could be simultaneously enabled for use by a metal option, having increasing sizes for these transistors allows just one of the transistors to be enabled for use. Results are from a SPICE simulation with the transistor sizes shown in the appendix.

TABLE 1

Affect of Programmable Reference Transistors

| Transistor Reference Number | W/L | $V_{BB}$ | $V_{REF}$ |
|---|---|---|---|
| not shown | 25/8 | −1.12 | 1.26 |
| 86 | 17/8 | −1.53 | 1.36 |
| 84 | 12/8 | −2.00 | 1.47 |
| 82 | 10/8 | −2.43 | 1.54 |
| 80 | 8/8 | −3.03 | 1.61 |

Differential Comparator

Differential comparator 20 receives the reference voltage $V_{REF}$ on the gate of p-channel transistor 68, while p-channel transistor 66 the bulk reference voltage $V_{BREF}$, which is an attenuated and level-shifted substrate voltage. P-channel transistors 66, 68 form a differential pair. P-channel transistors 74, 76 form a current source using the gate voltage reference from voltage divider 14. N-channel transistors 70, 72 are configured as a current mirror, with their gates and sources at identical voltages so that the current through transistor 70 is the same as the current through transistor 72.

Small difference between reference voltage $V_{REF}$ and bulk reference voltage $V_{BREF}$ are amplified by differential comparator 20 and output at the drains of transistors 68, 72 as voltage Vout. Thus even small differences can be detected. Since the differential comparator 20 is operating near its bias point, since substrate voltage changes are attenuated, the differential comparator is operating near its designed operating point and has a faster response time.

Inverting stage 22 includes p-channel transistors 92, 94 acting as a current source, and n-channel transistor 90, which shifts Vout up to a voltage closer to the switching threshold of a standard CMOS inverter. Inverter 96 acts as buffer 24 to provide a full CMOS voltage swing for enable signal 30. If the voltage swing on enable signal 30 were less that the full CMOS supply rails, then power could be consumed when oscillator 10 is disabled, or oscillator 10 could operate at a lower frequency due to increased resistance for enabling p-channel transistors 42.

Voltage Plot and Circuit Operation

FIG. 4 is a plot of various voltages in enable circuit 32 in the substrate bias generator. As substrate bias voltage $V_{BB}$ is ramped up, such as when substrate leakage occurs, bulk reference voltage $V_{BREF}$ decreases slightly, but by an attenuated amount.

The bulk reference voltage $V_{BREF}$ changes because the threshold voltage changes with the substrate bias, and this change in threshold is output at the drain of sensing transistor 60 which has its gate and drains connected. Since the current through sensing transistor 60 is kept constant by the p-channel current source transistors 62, 64, the change in threshold alters the drain voltage of transistor 60.

The programmable reference voltage $V_{REF}$ in this example is 1.6 volts, such as when the smallest programmable p-channel transistor 80 is enabled. Voltage divider 14 sets the gate voltages for the current sources. The upper p-channel gate voltage is set to 4.65 volts, while the lower p-channel gate voltage is 2.9 volts. The sources of differential pair p-channel transistors 66, 68 generally track $V_{BREF}$, but at about the 3-volt level.

When $V_{BREF}$ is equal to $V_{REF}$, the crossover point, differential comparator's 20 output and enable signal 30 switch from high (disable oscillator) to low (enable oscillator). This crossover point is changed by programming on a different p-channel transistor 80, 82, 84, 86. As shown in Table 1, the reference voltage $V_{REF}$ is a function of which programmable p-channel transistor is enabled. In turn, the programmed reference voltage $V_{REF}$ determines the crossover point where the oscillator is shut off, which determines $V_{BB}$ itself. Thus the programmable p-channel transistors 80, 82, 84, 86 determine the substrate bias voltage.

ADVANTAGES OF THE INVENTION

Since the programmable p-channel transistors 80, 82, 84, 86 determine the substrate bias voltage, the substrate bias may easily be changed by a programmable metal option. The maximum magnitude for $V_{BB}$ is still determined by the number of diode transistors used in the charge pump. For four diode transistors 50, 52, 54, 56, the maximum $V_{BB}$ is four thresholds, about −3 volts. This maximum (most negative) substrate bias occurs at steady-state when the oscillator is continuously enabled. The invention instead allows the actual substrate bias to be programmed for a value less than the maximum. Programming the p-channel transistors which set the reference voltage $V_{REF}$ determines the crossover point and the value of $V_{BB}$ which disables the oscillator. Thus while the maximum substrate bias is −3 volts, the actual substrate bias may be programmed to a lower value. For example, when the 12/8 programmable transistor 84 is enabled and the other disabled, the substrate bias is 2.0 volts. Once the charge pump pumps the substrate to −2.0 volts, the enable circuit disables the oscillator and pumping stops. Thus even though the charge pump has the capacity to pump to −3.0 volts, the bias generator may be programmed to pump to −2.0 volts.

It is possible to have a programmable metal option in the charge pump itself which could be used to determine the substrate bias. Additional diode transistors and capacitors are simply bypassed or put in series between the substrate and ground. Thus if two diode transistors are enabled instead of four, the substrate bias is −1.5 volts instead of −3.0 volts. However, this method is undesirable since the programmable metal options add parasitic capacitance to the critical pumping nodes. The added capacitance reduces the capacitive coupling ratio, which decreases the efficiency and pumping power of the charge pump. Thus the invention allows for programmable substrate bias without reducing the capability of the charge pump itself.

Power is also reduced with the invention since the oscillator is disabled part of the time. Power and silicon area can be traded off as well: the charge pump can be built with additional pumping capacity, but disabled for a greater portion of time to reach a desired substrate bias voltage. Thus the invention is more flexible than the prior art.

Since the differential comparator 20 is operating near its bias point, since substrate voltage changes are attenuated, the differential comparator is operating near its designed operating point and has a faster response time.

Another advantage of sensing with only the bulk terminal and not the gate, drain, or source terminals of a transistor is that transistor process parameters are tracked rather than just the absolute value of the substrate bias $V_{BB}$. Since the threshold voltage of the sensing transistor varies with the substrate bias, the affect on the attenuated voltage at the drain of sensing transistor 60 includes process parameters such as substrate doping which determine the magnitude of the body effect and the change in threshold voltage due to the substrate bias. Thus the enabling circuit can be used to match not just the raw substrate voltage, but the current through a transistor. Tracking or balancing of p-channel and n-channel transistors is possible by comparing the attenuated bias voltage to a reference voltage generated from a transistor which is not dependent on the substrate bias, such as a p-channel transistor.

ALTERNATE EMBODIMENTS

Several other embodiments are contemplated by the inventors. For example devices may be inverted from the p-channel and n-channel devices described herein, and other modifications may be made by those with skill in the art. While the invention has been described using enhancement-mode p-channel and n-channel CMOS transistors, other technologies such as GaAs FET's may be substituted. While discrete transistors have been described, those of skill in the an recognize that any transistor may have several legs or gates connected together so that the legs operate as a single electrical device. Likewise several transistors can be combined into a larger device. In particular the programmable p-channel transistors can be implemented not just as discrete transistors as described, but as several gate legs or fingers, with each finger being enabled or disabled separately, and larger transistor sizes being constructed by enabling a greater number of fingers rather than separate devices.

Two charge pumps may be used, driven by the same clocks CK1, CK2 from the oscillator. Having two charge pumps driven by the same oscillator allows for faster pumping and some redundancy.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

APPENDIX—DEVICE SIZES

The transistors W/L sizes, in microns, are shown below in the third column. The second column lists the reference number for the transistors shown in FIG. 2, 3. Capacitors are implemented with n-channel enhancement transistors with the gate as one terminal of the capacitor and the drain and source connected together as the other capacitor terminal. Of course many other sizes could be used.

| Ring Oscillator 10: | | |
|---|---|---|
| PMOS | 42 | 4/2 |
| PMOS | 38 | 4/2 |
| NMOS | 36 | 4/4 |

-continued

| | | |
|---|---|---|
| When the stage drives CK1 or CK2, the sizes are: | | |
| PMOS | 42 | 10/.7 |
| PMOS | 38 | 10/.7 |
| NMOS | 36 | 4/.6 |
| Charge Pump 12: | | |
| NMOS | 44, 46, 48 | 25/25 (Capacitors) |
| NMOS | 50, 52, 54, 56 | 20/.6 |
| Voltage Divider 14: | | |
| PMOS | 98 | 50/1.2 |
| PMOS | 100 | 50/1.2 |
| Resistor | 102 | 140 Kohm |
| Substrate Sensor 16: | | |
| PMOS | 64 | 20/1.2 |
| PMOS | 62 | 20/1.2 |
| NMOS | 60 | 45/4 |
| Differential Comparator 20: | | |
| PMOS | 76 | 50/1.2 |
| PMOS | 74 | 50/1.2 |
| PMOS | 66, 68 | 20/2 |
| NMOS | 70, 72 | 5/5 |
| Programmable Reference 18: | | |
| PMOS | 78 | 27/1.2 |
| PMOS | 88 | 27/1.2 |
| PMOS | 80 | 8/8 |
| PMOS | 82 | 10/8 |
| PMOS | 84 | 12/8 |
| PMOS | 86 | 17/8 |
| Inverting stage 22: | | |
| PMOS | 94 | 50/1.2 |
| PMOS | 92 | 50/1.2 |
| NMOS | 90 | 10/5 |
| Buffer 24: | | |
| PMOS | 96 | 4/2 |
| NMOS | 96 | 4/2 |

We claim:

1. A substrate bias generator for generating a substrate bias voltage applied to a substrate comprising:

an enabling signal;

oscillator means, responsive to the enabling signal, for generating a clock in response to the enabling signal in a first state, the oscillator means entering a low-power-consumption mode in response to the enabling signal not in the first state;

charge pump means, responsive to the clock from the oscillator means, for pumping charge to a substrate, the charge pump means generating the substrate bias voltage and outputting the substrate bias voltage to the substrate;

enable circuit means, responsive to the substrate bias voltage, for generating the enabling signal, the enable circuit means comprising:

sensing means, receiving the substrate bias voltage but not drawing active current from the substrate, the sensing means generating an attenuated bias reference voltage attenuated from the substrate bias voltage, the sensing means comprising an n-channel MOS transistor with:

a bulk terminal receiving the substrate bias voltage, the bulk terminal not drawing active current but only drawing leakage currents;

a source terminal connected to ground;

a drain terminal outputting the attenuated bias reference voltage;

a gate terminal for controlling current through the drain terminal, the gate terminal being electrically connected to the drain terminal, wherein the changes in the substrate bias voltage change the threshold voltage of the n-channel MOS transistor, the attenuated bias reference voltage at the drain terminal changing in response to a change in the threshold voltage of the n-channel MOS transistor;

a reference voltage; and differential compare means, receiving the attenuated bias reference voltage and the reference voltage, for comparing the attenuated bias reference voltage to the reference voltage and outputting the enabling signal in the first state when the substrate bias voltage exceeds a set point determined by the reference voltage;

whereby active current is not drawn from the substrate by the enable circuit means.

2. The substrate bias generator of claim 1 wherein the sensing means further comprises a current source.

3. The substrate bias generator of claim 2 wherein the enable circuit means further comprises:

programmable reference generator means for generating the reference voltage, the programmable reference generator means having a plurality of programmable settings, the programmable settings determining the reference voltage, the reference voltage determining a set point, wherein the differential compare means outputs the enabling signal in the first state when the substrate bias voltage has risen above the set point determined by the reference voltage.

4. The substrate bias generator of claim 3 wherein the programmable reference generator means comprises:

a plurality of transistors; and programmable means, coupled to the plurality of transistors, for enabling individual transistors in the plurality of transistors but for disabling others transistors in the plurality of transistors, wherein the reference voltage is determined by individual transistors which are enabled.

5. The substrate bias generator of claim 4 wherein the programming means comprises a metal option line for connecting a gate terminal of an individual transistor to a power supply or ground.

6. The substrate bias generator of claim 4 wherein the plurality of transistors comprise p-channel transistors.

7. The substrate bias generator of claim 6 wherein the p-channel transistors have their bulk terminals and their drain terminals connected to the reference voltage.

8. The substrate bias generator of claim 7 wherein the differential compare means further comprises:

a differential amplifier, receiving the reference voltage and the attenuated bias reference voltage on gate terminals of a differential pair of transistors, the differential amplifier outputting a difference signal representing a voltage difference between the reference voltage and the attenuated bias reference voltage;

inverting stage means, receiving the difference signal from the differential amplifier, for inverting a voltage of the difference signal to a second voltage having a switching threshold near a midrange of a power supply and ground;

buffer means, receiving the second voltage, for driving the enabling signal.

9. The substrate bias generator of claim 8 wherein the differential pair of transistors comprise a pair of p-channel transistors, the differential amplifier further comprising a current mirror for supplying a mirrored current to each transistor in the pair of p-channel transistors.

10. The substrate bias generator of claim 1 wherein the substrate is selected from the group consisting of a P-well, and a p-type substrate.

11. A bias generator for generating a substrate bias, comprising:

an oscillator having an enable signal input for disabling the oscillator;

a charge pump, responsive to the oscillator, for generating the substrate bias; and an enable circuit for generating the enable signal comprising:

a programmable reference-voltage generator having a plurality of transistors in parallel, and means for enabling some transistors in the plurality of transistors but disabling other transistors in the plurality of transistors in order to set a reference voltage;

a sense transistor having its bulk terminal connected to the substrate bias and its source terminal connected to a constant-voltage supply, for attenuating the substrate bias to generate at its drain terminal a sensed substrate bias, and a comparator, receiving the reference voltage and the sensed substrate bias, for outputting the enable signal when the sensed substrate bias reaches the reference voltage, whereby the number of transistors enabled sets a threshold which determines when the enable signal is generated.

12. The bias generator of claim 11 wherein the constant-voltage supply connected to the source terminal of the sensing transistor is a ground supply and wherein the sensing transistor is an n-channel transistor.

13. The bias generator of claim 12 wherein the sense transistor has a gate terminal connected to its drain terminal.

14. A substrate bias generator comprising:

an oscillator for generating a series of pulses, the oscillator enabled in response to a first signal;

a charge pump for generating a substrate bias voltage to a substrate in response to the series of pulses from the oscillator, the charge pump capable of generating a maximum bias for the substrate bias voltage when the series of pulses is continuous;

a sensing transistor having only its bulk input connected to the substrate bias voltage from the charge pump, the sensing transistor having a source connected to a ground and a drain and a gate connected to an output, the sensing transistor outputting at the drain a substrate reference voltage in response to the substrate bias voltage connected to the bulk input;

a reference bias;

a differential comparator receiving the substrate reference voltage from the sensing transistor and the reference bias, for outputting the first signal in response to a difference between the substrate reference voltage from the sensing transistor and the reference bias, whereby the substrate bias voltage to the substrate is determined by the reference bias, a value for the substrate bias voltage being less than the maximum bias for the substrate bias voltage when the series of pulses is continuous.

15. The substrate bias generator of claim 14 wherein the charge pump comprises a plurality of series-connected n-channel transistors each having its gate connected to its drain, the maximum bias for the substrate bias voltage determined by the number of transistors in the plurality of series-connected n-channel transistors; and wherein the sensing transistor is an n-channel transistor.

* * * * *